US009103228B2

(12) United States Patent
Waugh et al.

(10) Patent No.: US 9,103,228 B2
(45) Date of Patent: Aug. 11, 2015

(54) VARIABLE STATOR VANE CONTROL SYSTEM

(75) Inventors: Daniel Richard Waugh, Simpsonville, SC (US); Brian Allen Rittenhouse, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1005 days.

(21) Appl. No.: 13/204,771

(22) Filed: Aug. 8, 2011

(65) Prior Publication Data

US 2013/0039736 A1 Feb. 14, 2013

(51) Int. Cl.
*F01D 17/16* (2006.01)

(52) U.S. Cl.
CPC ..... *F01D 17/162* (2013.01)

(58) Field of Classification Search
CPC ... F01D 17/162; F01D 17/167; F01D 17/148; F01D 25/246; F04D 29/462; F04D 29/464
USPC ..... 415/148, 149.1, 149.2, 149.4, 150, 415/154.2, 154.3, 155, 159, 160, 162, 165, 415/198.1, 191, 193, 199.2, 199.4, 199.5, 415/208.1, 208.2, 209.2
See application file for complete search history.

(56) References Cited

U.S. PATENT DOCUMENTS

| | | | | |
|---|---|---|---|---|
| 4,430,043 | A * | 2/1984 | Knight et al. | 415/159 |
| 4,874,287 | A * | 10/1989 | Grieb | 415/149.2 |
| 6,794,766 | B2 | 9/2004 | Wickert et al. | |
| 6,808,364 | B2 | 10/2004 | O'Reilly et al. | |
| 7,096,657 | B2 * | 8/2006 | Mahoney et al. | 60/39.25 |
| 7,802,964 | B2 * | 9/2010 | Bouru | 415/160 |
| 8,591,173 | B2 * | 11/2013 | Bouru et al. | 415/36 |
| 2004/0022624 | A1 * | 2/2004 | Harrold | 415/162 |
| 2006/0110246 | A1 | 5/2006 | Bruce | |
| 2007/0048126 | A1 | 3/2007 | Schilling | |
| 2007/0128017 | A1 | 6/2007 | Gutknecht et al. | |
| 2007/0166150 | A1 | 7/2007 | Szues et al. | |
| 2008/0025839 | A1 | 1/2008 | Schilling | |
| 2010/0260591 | A1 | 10/2010 | Martin et al. | |
| 2010/0278639 | A1 | 11/2010 | Hood et al. | |

* cited by examiner

*Primary Examiner* — Edward Look
*Assistant Examiner* — Christopher J Hargitt
(74) *Attorney, Agent, or Firm* — Sutherland Asbill & Brennan LLP

(57) ABSTRACT

The present application provides a variable stator vane control system. The variable stator vane control system may include a variable stator vane positioned by an actuator and a trimmer motor, a resolver to determine a position of the variable stator vane, and a controller in communication with the resolver, the actuator, and the trimmer motor to prevent over travel of the variable stator vane.

19 Claims, 3 Drawing Sheets

VARIABLE STATOR VANE CONTROL SYSTEM

TECHNICAL FIELD

The present application and the resultant patent relate generally to gas turbine engines and more particularly relate to a variable stator vane control system so as to avoid mechanical interference with a rotor blade through the use of hydraulic actuators and electric trimmer motors.

BACKGROUND OF THE INVENTION

Generally described, gas turbine engines include a compressor to compress an incoming flow of air for combustion with a compressed flow of fuel in a combustor. The compressor includes a number of progressively higher pressure stages. Each stage includes a row of rotor blades mounted on a rotor and a number of stator vanes mounted on a casing. The compressor also may use a number of variable stator vanes. The variable stator vanes generally extend between adjacent rotor blades. The variable stator vanes are rotatable about an axis so as to direct the airflow through the compressor. The variable stator vanes thus may control the quantity of air flowing through the compressor so as to facilitate optimized performance. The size and configuration of the variable stator vanes may vary.

Control of the angle of the variable stator vanes thus is required so as to provide this optimized performance. Mechanical interference or clashing of rotor blades and the variable stator vanes, however, may result if the variable stator vanes extend too far open or closed. Such mechanical inference or clashing may result in component damage. Moreover, significant downtime thus may result from such clashing and may require extensive repair.

There is thus a desire therefore for improved variable stator vane control systems. Such improved control systems should avoid mechanical interference between the variable stator vanes and rotor blades while providing optimized airflow for overall system efficiency and output.

SUMMARY OF THE INVENTION

The present application and the resultant patent thus provide a variable stator vane control system. The variable stator vane control system may include a variable stator vane positioned by an actuator and a trimmer motor, a resolver to determine a position of the variable stator vane, and a controller in communication with the resolver, the actuator, and the trimmer motor to prevent over travel of the variable stator vane.

The present application and the resultant patent further provide a method of controlling a variable stator vane by an actuator and a trimmer motor to prevent interference with a rotor blade. The method may include the step of determining a rotational position of the variable stator vane. If the variable stator vane is too far open, then closing the actuator and stopping the trimmer motor. If the variable stator vane is too far closed, then opening the actuator and stopping the trimmer motor.

The present application and the resultant patent further provide a variable stator vane control system to prevent interference with a rotor blade. The variable stator vane control system may provide a number of variable stator vanes positioned on an actuation ring, the variable stator vanes positioned by an actuator and a trimmer motor in communication with the actuation ring, a resolver to determine a position of one or more of the variable stator vanes, and a controller in communication with the resolver, the actuator, and the trimmer motor in prevent interference with the rotor blade by the variable stator vanes.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
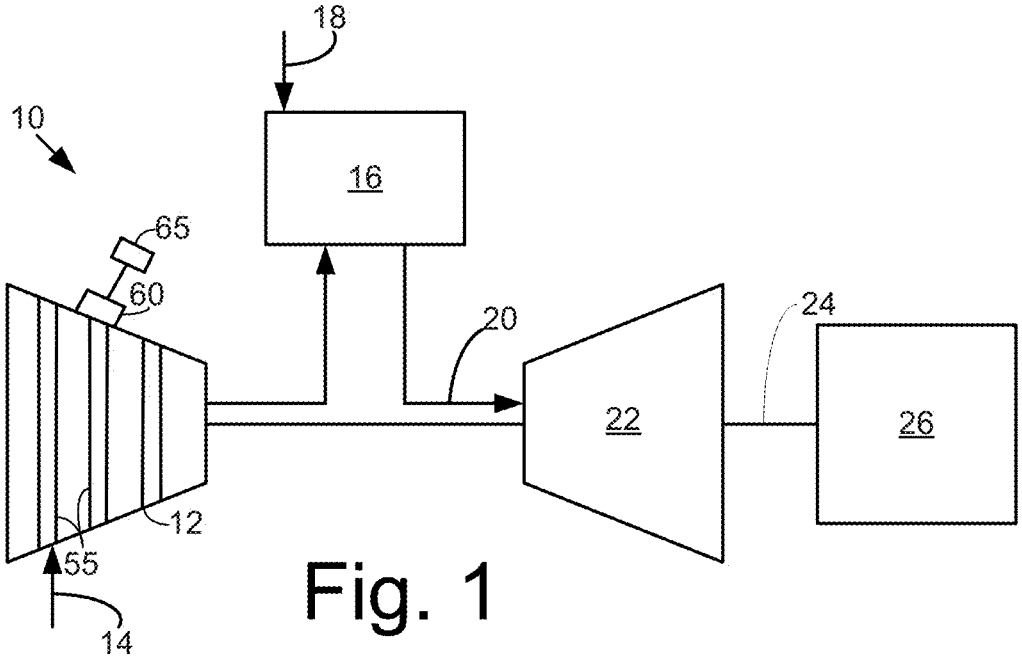
FIG. 1 is a schematic diagram of a gas turbine engine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
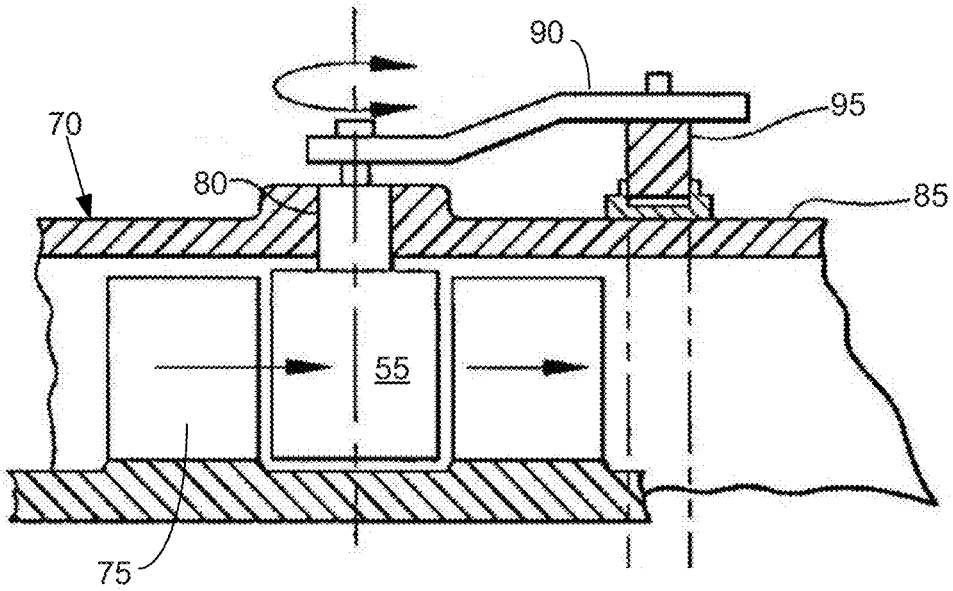
FIG. 2 is a partial side cross-sectional view of a variable stator vane assembly.

As is shown in FIGS. 1 and 2, the compressor 15 may include a number of variable stator vanes 55. The variable stator vanes 55 may have any desired size, shape, and configuration. The variable stator vanes 55 may be maneuvered via an actuator 60 in response to a controller 65. The controller 65 instructs the actuator 60 to rotate the variable stator vanes 55 according to any number of operational parameters to the appropriate angle.

FIG. 2 shows a stage 70 of the compressor 15. Each stage includes a row of the variable stator vanes 55 and a row of rotor blades 75. Each variable stator vane 55 may include a stem 80. The stem 80 may protrude through a casing 85 of the compressor 15. The stem 80 may be attached to a lever arm 90 for rotation therewith. The lever arm 90 in turn may be in communication with an actuation ring 95. The actuation ring 95 may be in communication with the actuator 60 for movement therewith. The actuation ring 95 surrounds the casing 85. The actuator ring 95 may be in communication with a number of the lever arms 90 and the variable stator vanes 55. Movement of the actuation ring 95 thus translates into movement of the variable stator vanes 55. Given such, the actuator 60 may maneuver all of the variable stator vanes 55 on a given actuation ring 95 in unison through a range of vane angles. Other components and other configurations may be used herein.

Figure 3:
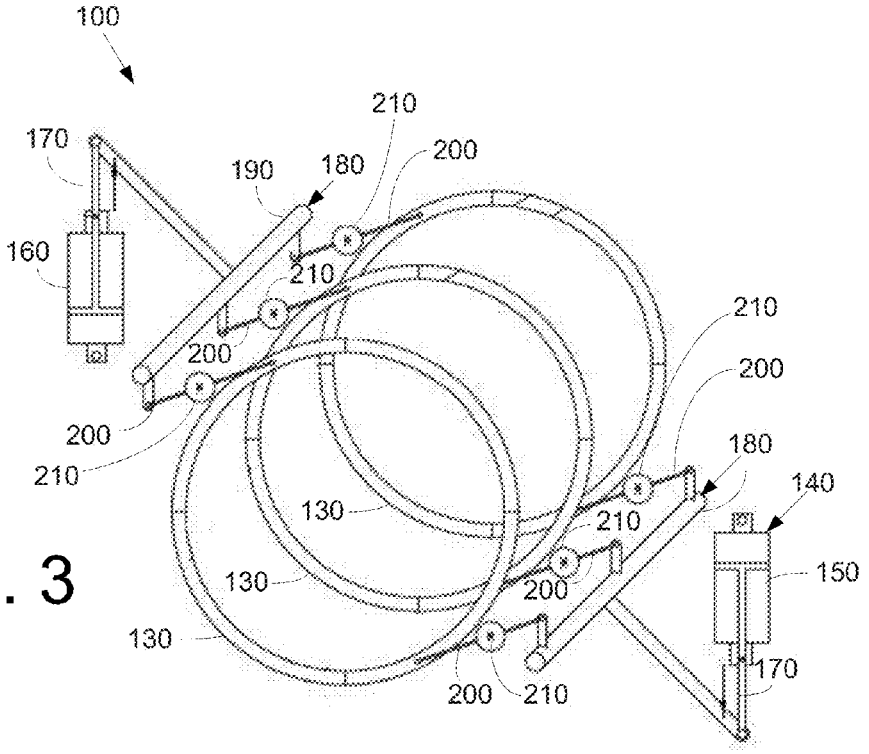
FIG. 3 is a partial perspective view of a variable stator vane control system as may be described herein.
Figure 4:
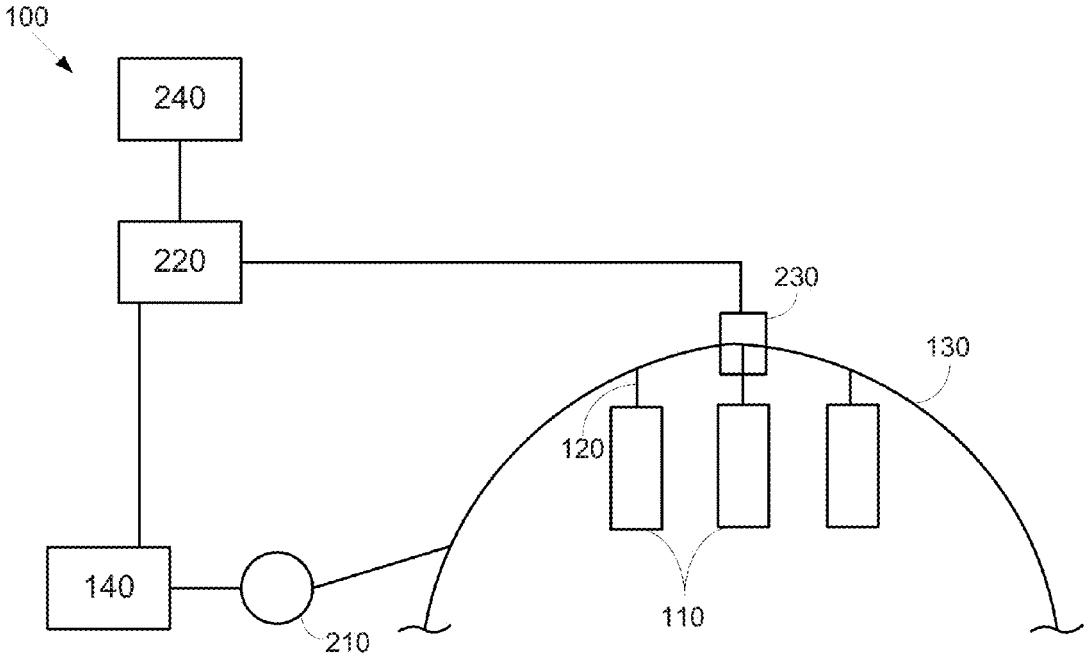
FIG. 4 is a schematic diagram of the variable stator vane control system of FIG. 3.

FIGS. 3 and 4 show a variable stator vane control system 100 as may be described herein. The variable stator vane control system 100 may be positioned within the compressor 15 in a manner similar to that described above. The variable stator vane control system 100 includes a number of variable stator vanes 110. The variable stator vanes 110 may have any desired size, shape, or configuration. Each variable stator vane 110 may have a stem 120 on one end thereof. Each variable stator vane 110 may be in communication with an actuation ring 130 via the stem 120. The actuation ring 130 may have any desired diameter and may surround the casing 85 of the compressor 15. One or more lever arms also may be used.

Each actuation ring 130 may be in communication with an actuator 140. In this example, the actuator 140 may be a hydraulic actuator. Other types of actuating devices may be used herein. As is shown, a first actuator 150 and a second actuator 160 may be used, although any number of actuators 140 may be used herein. Each actuator 140 may have a piston 170 for linear drive and control. Other components and other configurations may be used herein.

Each actuation ring 130 or a set thereof, may be in communication with the actuators 140 via a linkage assembly 180. The linkage assembly 180 may have a crossbar 190 in communication with the piston 170 of each actuator 140. The crossbar 190, in turn, may include any number of ring arms 200 extending therefrom. Each ring arm 200 is in communication with an actuation ring 130. Any number of ring arms 200 and actuation rings 130 may be maneuvered by the crossbar 190. Each actuator 140 may have a linkage assembly 180 in communication therewith. Other components and other configurations may be used herein.

Each ring arm 200 may be further maneuvered via a trimmer motor 210. The trimmer motor 210 may be an electrical motor and the like. The trimmer motor 210 allows for maneuvering of each ring arm 200 and, hence, each individual actuation ring 130 for more precise control as compared to the crossbar 190 and the actuator 140 maneuvering a number of actuation rings 130. Other components and other configurations may be used herein.

The variable stator vane control system 100 also may include a controller 220. The controller 220 may be any type of programmable control device. The controller 220 may be used to control the various components of the gas turbine engine 10 in general or the compressor 15 in specific. The controller 220 also may be dedicated to the variable stator vane control system 100. The controller 220 may be in communication with each actuator 140 and each trimmer motor 210. The controller 220 also may be in communication with one or more resolvers 230. The resolvers 230 may determine the rotational position of one or more of the variable stator vanes 110. Other types of positioning sensors also may be used herein.

The controller 220 also may be in communication with any number of other types of inputs 240. The inputs 240 may relate to any number of different operational parameters with respect to the variable stator vane control system 100 and/or the gas turbine engine 10 as a whole. Other types of controllers and other types of sensors also may be used herein. Other components and other configurations may be used herein.

Figure 5:
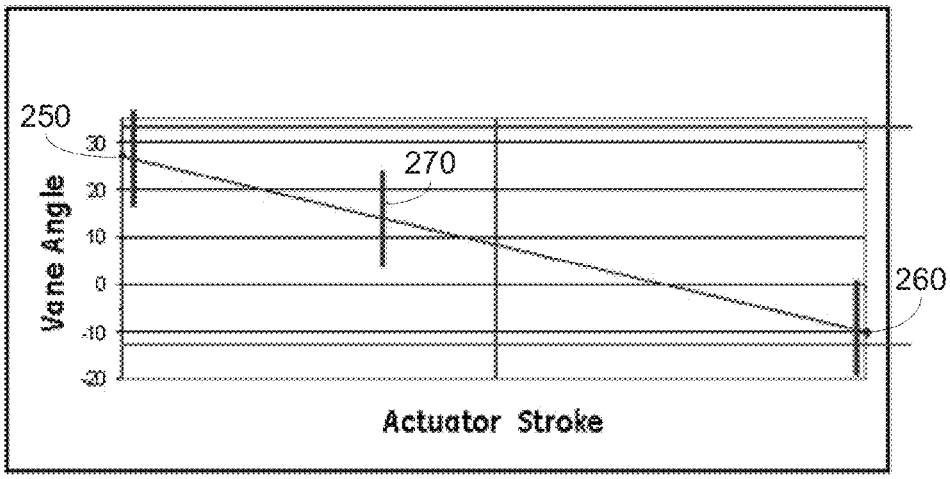
FIG. 5 is a graph showing vane angle versus actuator stroke.

In use, the actuators 140 may maneuver the variable stator vanes 110 on a number of actuation rings 130 in response to the controller 220. Further, the trimmer motors 210 may provide more precise control on positioning of the variable stator vanes 110 on an individual actuation ring 130 or a portion thereof. As is shown in FIG. 5, the variable stator vanes 110 may rotate from a closed position 250 to an open position 260 based upon the stroke of the actuators 140. In other words, the linear position of the piston 170 of the actuators 140 drives the linkage assembly 180 and the actuation rings 130. Similarly, more precise (but more limited) control may be provided by the trimmer motors 210 within a trim range 270. Full extension of the trimmer motor 210, however, may be restricted in the closed position 250 or the open position 260 due to mechanical restrictions with the adjacent rotor blades 75 or other components within the compressor 15.

Figure 6:
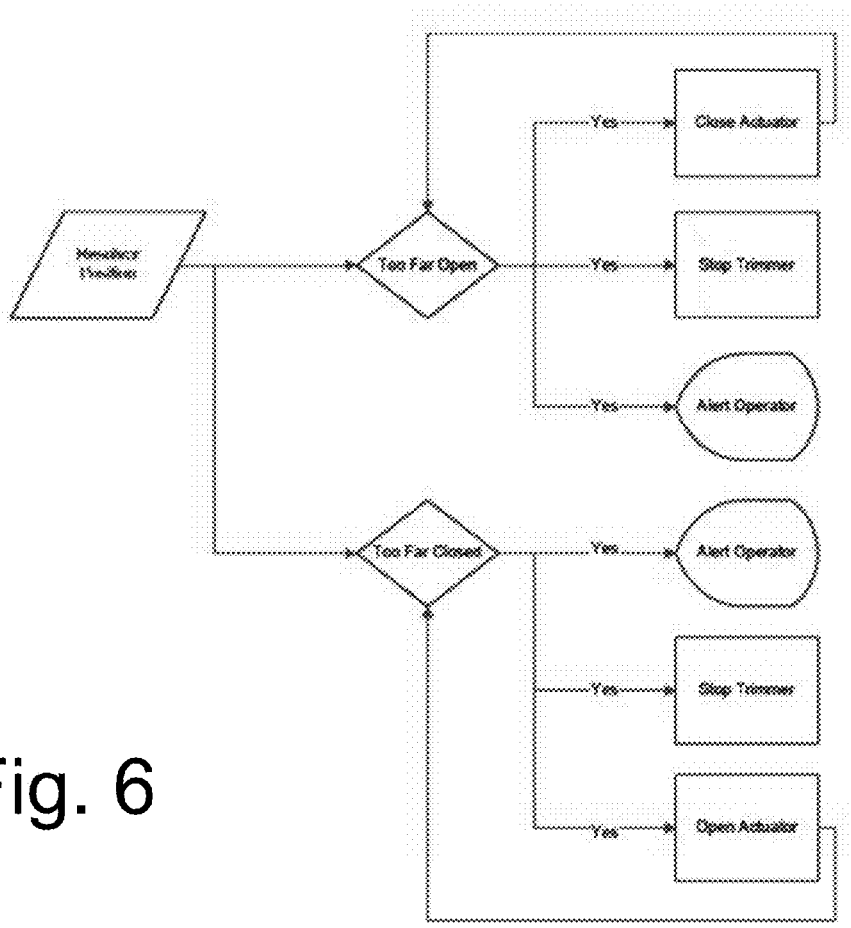
FIG. 6 is flowchart showing the control logic used in the variable stator vane control system of FIG. 3.

FIG. 6 shows an example of control logic to avoid such mechanical interference between the variable stator vanes 110 and the adjacent rotor blades 75. The resolvers 230 provide the rotational position for the vane angle for some or all of the variable stator vanes 110 to the controller 220. The controller 220 may take action via the actuators 140, the trimmer motors 210, and/or so as both to prevent mechanical interference in either the closed position 250, the open position 260, or elsewhere. If the controller 220 determines that the variable stator vanes 110 of a given actuation ring 130 are too far open, the controller 220 will close the actuators 140, stop the trimmer motors 210, and alert an operator. Similarly, if the controller 220 determines that the variable stator vanes 110 on a given actuation ring 130 are too far closed, the controller 220 will open the actuators 140, stop the trimmer motors 210, and alert an operator. The methods steps may be continuously repeated herein. The rotational information provided by the resolvers 230 thus may be utilized to bias or adjust the actuators 140 or the trimmer motors 210 to bring the variable stator vanes 110 to a safe position. For example, if the trimmers are retracted about five (5) degrees too far or so, the actuators 140 will bias themselves about five (5) degrees further open for a given actuation ring 130 such that mechanical limits are not realized and clashing with the rotor blades 75 may be prevented.

As the error comes out of the overall system 100, the actuators 140 will return to nominal positions so as to maintain overall efficient operation and provide alignment with the inlet guide vanes (not shown) or other components. The variable stator vane control system 100 thus prevents mechanical interference or clashing of the variable stator vanes 110 and the rotor blades 75 due to over travel in both the closed position 250 and the open position 260 while allowing full validation of the system 100 as a whole. Such avoidance should reduce overall compressor maintenance and downtime while providing efficient operation.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A variable stator vane control system, comprising:

a plurality of variable stator vanes positioned on an actuation ring;

each of the plurality of variable stator vanes positioned by an actuator and an individual trimmer motor, the individual trimmer motor positioned in between the respective variable stator vane and the actuator;

a resolver configured to determine a position of each of the plurality of variable stator vanes; and a controller in communication with the resolver, the actuator, and each individual trimmer motor to prevent over travel of the variable stator vane.

2. The variable stator vane control system of claim 1, wherein each individual the trimmer motor is in communication with the actuation ring.

3. The variable stator vane control system of claim 1, further comprising a plurality of actuation rings and wherein the actuator is in communication with the plurality of actuation rings.

4. The variable stator vane control system of claim 1, wherein the actuator comprises a hydraulic actuator.

5. The variable stator vane control system of claim 1, wherein the actuator comprises a piston.

6. The variable stator vane control system of claim 1, further comprising a plurality of actuators.

7. The variable stator vane control system of claim 1, wherein each individual trimmer motor comprises an electrical trimmer motor.

8. The variable stator vane control system of claim 1, further comprising a linkage assembly in communication with each of the plurality of variable stator vanes, the actuator, and each individual trimmer motor.

9. The variable stator vane control system of claim 8, wherein the linkage assembly comprises a crossbar in communication with the actuator.

10. The variable stator vane control system of claim 9, wherein the linkage assembly comprises a ring arm in communication with the crossbar and each individual trimmer motor.

11. The variable stator vane control system of claim 10, wherein the linkage assembly comprises a plurality of ring arms.

12. A method of controlling a variable stator vane by an actuator and an individual trimmer motor associated with the variable stator vane to prevent interference with a rotor blade, comprising:

determining a rotational position of the variable stator vane; and if the variable stator vane is too far open, then:

closing the actuator; and stopping the trimmer motor; or if the variable stator vane is too far closed, then:

opening the actuator;

starting the trimmer motor associated with the variable stator vane while stopping another trimmer motor associated with a different variable stator vane; and stopping the trimmer motor after the variable stator vane does not interfere with the rotor blade.

13. The method of claim 12, further comprising the step of alerting an operator is the variable stator vane is too far open or too far closed.

14. The method of claim 12, further comprising the step of determining if the variable stator vane is in an open position or a closed position.

15. A variable stator vane control system to prevent interference with a rotor blade, comprising:

a plurality of variable stator vanes positioned on an actuation ring;

the plurality of variable stator vanes positioned by an actuator and a trimmer motor in communication with the actuation ring, wherein each of the plurality of variable stator vanes comprises an individual trimmer motor associated therewith, and the trimmer motor is positioned in between one of the plurality of variable stator vanes and the actuator;

a resolver to determine the position of one or more of the variable stator vanes; and a controller in communication with the resolver, the actuator, and the trimmer motor to prevent interference with the rotor blade by the plurality of variable stator vanes.

16. The variable stator vane control system of claim 15, further comprising a plurality of actuation rings and wherein the actuator is in communication with the plurality of actuation rings.

17. The variable stator vane control system of claim 1, wherein the actuator comprises a hydraulic actuator.

18. The variable stator vane control system of claim 1, wherein the trimmer motor comprises an electrical trimmer motor.

19. The variable stator vane control system of claim 15, further comprising a linkage assembly in communication with the actuation ring, the actuator, and the trimmer motor.

* * * * *